US005830056A

United States Patent [19]

Adams et al.

[11] Patent Number: 5,830,056

[45] Date of Patent: Nov. 3, 1998

[54] BAGGING SPOUT FOR COIN HANDLING MACHINE

[75] Inventors: Thomas P. Adams, Oconomowoc; Cory A. Kohls, Watertown; Joseph P. Hanus, Johnson Creek; Myron W. Spoehr, Lake Mills, all of Wis.

[73] Assignee: Brandt, Inc., Watertown, Wis.

[21] Appl. No.: 752,962

[22] Filed: Dec. 2, 1996

[51] Int. Cl.[6] ..... B65B 67/04

[52] U.S. Cl. ..... 453/63; 248/101

[58] Field of Search ..... 453/63; 248/99, 248/101; 141/314, 315, 316

[56] References Cited

U.S. PATENT DOCUMENTS

| | | | |
|---|---|---|---|
| 1,725,345 | 8/1929 | Donnellan | 248/101 |
| 3,091,422 | 5/1963 | Hobbs | 248/101 |
| 5,295,899 | 3/1994 | Adams et al. | 453/10 |
| 5,443,419 | 8/1995 | Adams et al. | 453/17 |

FOREIGN PATENT DOCUMENTS

| | | | |
|---|---|---|---|
| 38213 | 8/1909 | Austria | 248/101 |

*Primary Examiner*—F. J. Bartuska
*Attorney, Agent, or Firm*—Quarles & Brady

[57] ABSTRACT

A bagging spout for a coin handling machine has an inclined chute extending between an upper inlet and a lower outlet. A spreader plate extends downwardly adjacent the outlet. A clamp member is hinged to the top of the spout adjacent the inlet. The clamp member has spaced ears that engage the outside of parallel side portions of the chute to pinch a coin bag between the ears and the chute.

7 Claims, 3 Drawing Sheets

FIG. 2
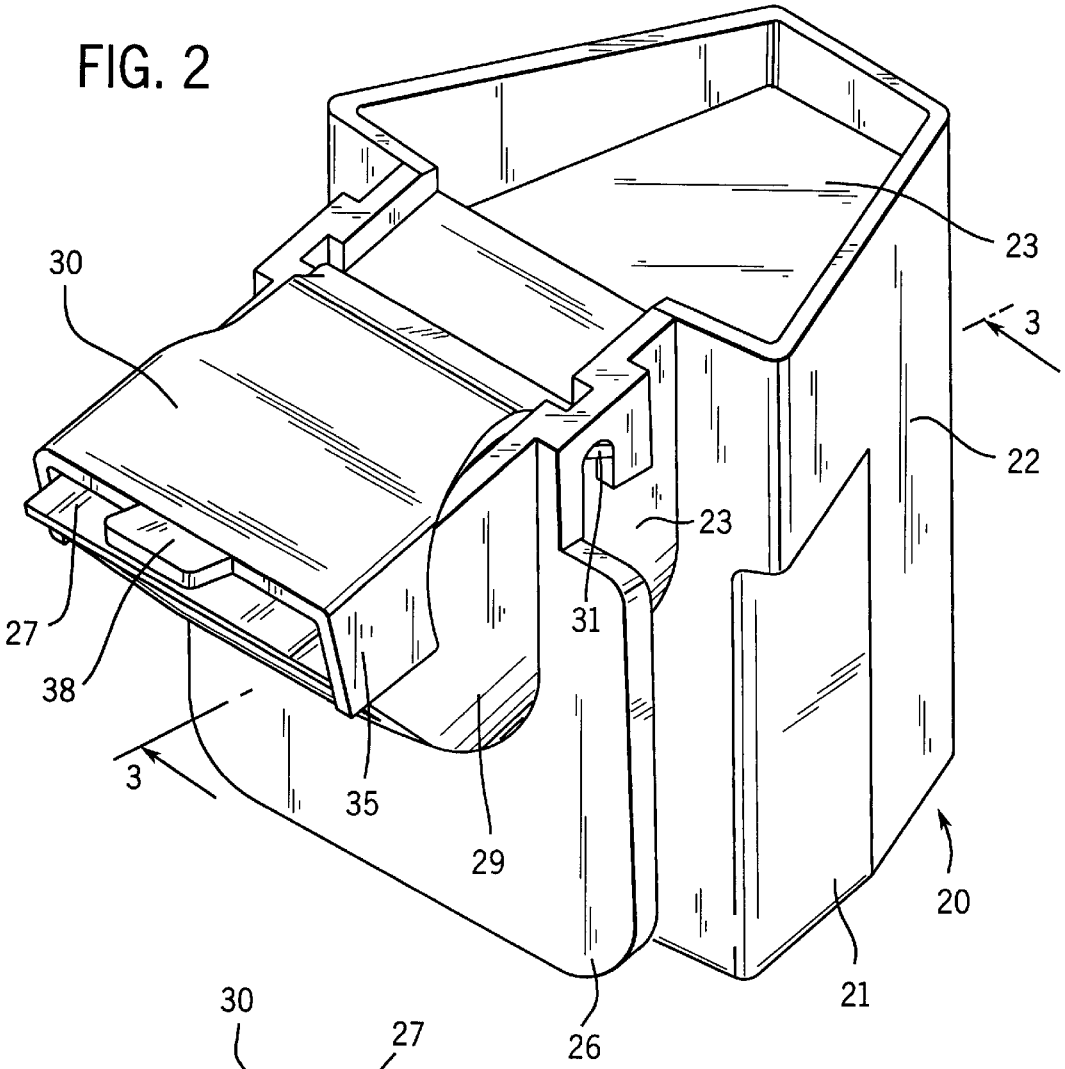
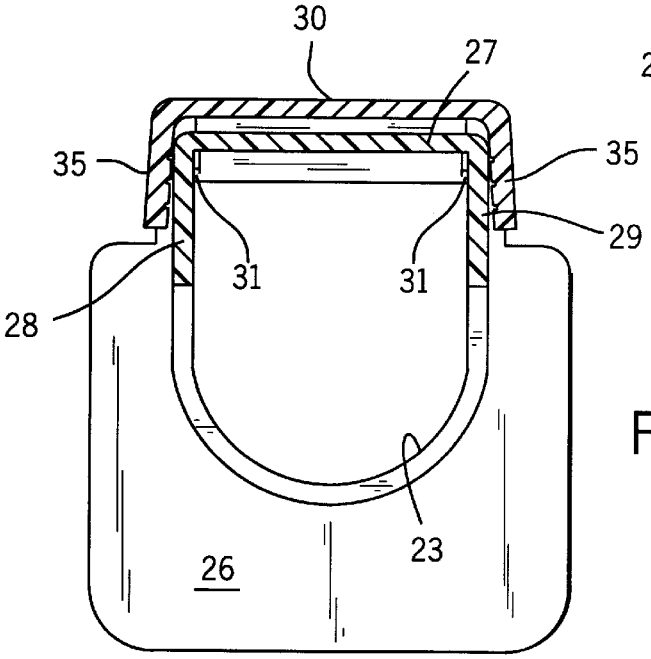
FIG. 4

BAGGING SPOUT FOR COIN HANDLING MACHINE

BACKGROUND OF THE INVENTION

This invention relates to coin handling machines and particularly to a spout to which a coin bag can be attached for the delivery of coins through the spout into the bag.

Coin handling machines, such as coin sorters, often discharge coins of a single denomination into a coin bag. A filled coin bag can be quite heavy. Therefore, it is necessary to provide a positive attachment of the coin bag to the coin discharge point on the coin handling machine.

In the past, bags have been attached to spouts using a metal ring surrounding a cylindrical spout with the bag pinched between the ring and the periphery of the spout. An example of this form of bagging spout is shown in U.S. Pat. No. 5,443,419 issued Aug. 22, 1995 to Adams, et al. for "Collector Assembly for Coin Handling Machine". Another form of bagging attachment that has been used incorporates a spring-loaded clamp that is spaced from a coin spout. A gathered portion of the coin bag is pinched in the clamp to hold the bag supported on one side by the spout and on another side by the clamp.

Our invention provides a simplified bagging spout.

SUMMARY OF THE INVENTION

In accordance with the invention, we provide a bagging spout which includes a spout member having an inlet and an outlet. A spreader plate extends transversely from the spout member rearward of the outlet. A cover member is hinged to the top side of the spout member and includes spaced ears. The mouth of a coin bag is wrapped around the spout members behind the spreader plate while the cover is open. The cover is then closed to trap the bag between the ears and the outside of the spout member.

In the preferred embodiment, the top side of the spout member is open except for a bridge portion at the outlet. An inclined chute extends from the inlet to the outlet. The cover closes the top of the spout member when the cover is closed around the bag. The cover has a forward lip portion that extends away from the bridge portion to facilitate manual grasping.

Further in accordance with the invention, a bagging spout having the characteristics described above is incorporated into a collector that is removably mounted beneath a coin discharge point of a coin handling machine. The collector can be interchangeable with other forms of collectors, such as coin drawers. In the preferred embodiment, the collector has a wedge shape so that it can be arrayed with like wedge-shaped collectors in a circle beneath a coin handling machine.

It is a principal object of the invention to provide a simple, yet effective bagging spout for a coin handling machine.

It is a further object of the invention to provide a bagging spout with a hinged manually grasped cover which pinches a coin bag between the cover and the spout.

The foregoing and other objects and advantages of the invention will appear in the detailed description which follows. In the description, reference is made to the accompanying drawings which illustrate a preferred embodiment of the invention.

BRIEF DESCRIPTION OF THE DRAWINGS

FIG. 2 is a view in perspective of the bagging spout;

FIG. 4 is a view in vertical section taken in the plane of the line 4—4 of FIG. 3.

DETAILED DESCRIPTION OF THE PREFERRED EMBODIMENT

Figure 1:
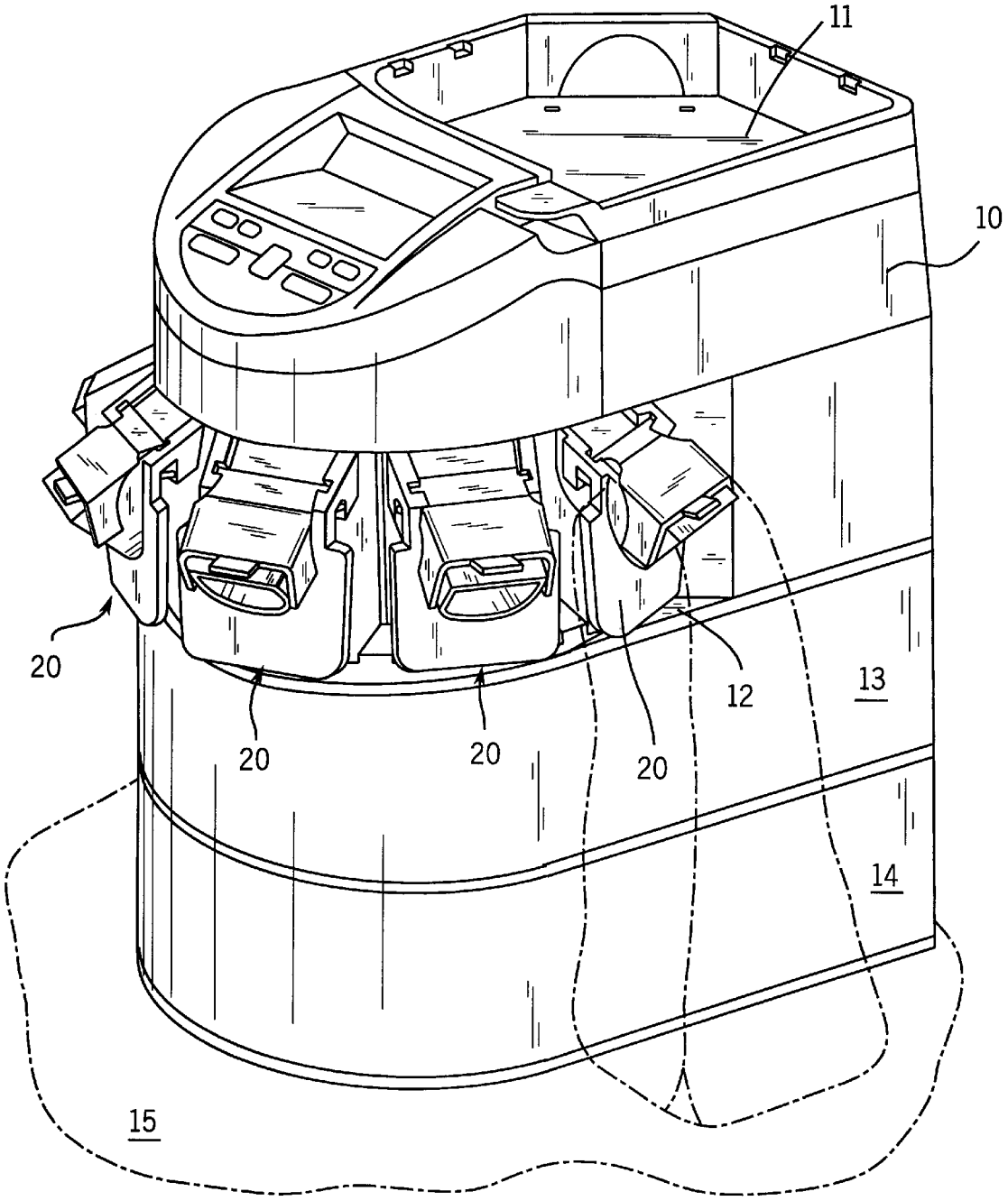
FIG. 1 is a view in perspective of a coin sorting machine incorporating the bagging spout of the present invention.
Figure 3:
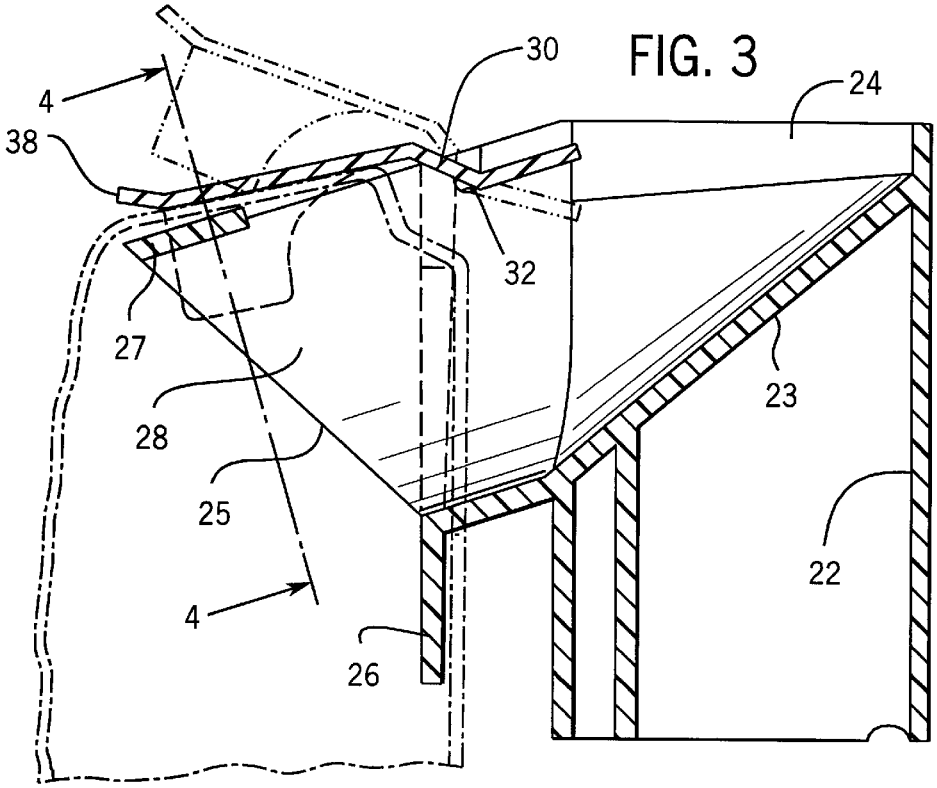
FIG. 3 is a view in vertical section of the bagging spout of FIG. 2 taken in the plane of the line 3—3 in FIG. 2.

The bagging spout is usable with a variety of coin handling equipment, including coin sorters of the type shown in U.S. Pat. No. 5,295,899 issued Mar. 22, 1994, for "Two Disc Coin Handling Apparatus". In such coin sorter, coins are deposited on the surface of a rotating disc which forms the coins into a single file in a single layer and feeds the aligned coins to a sorting plate in which the coins exit at spaced openings in the plate depending upon their size. Each denomination of coin to be sorted can be discharged into a respective one of a plurality of collectors. Various forms of collectors are illustrated and described in the aforesaid U.S. Pat. No. 5,443,419. Specifically, the coin sorter 10 receives coins in a hopper 11. The sorter 10 has a bottom shelf 12 which rests upon spacers 13 and 14 to elevate the sorter above the level of a tabletop 15 to accommodate coins bags. A plurality of bagging spouts indicated generally by the numeral 20 are arranged in a circle supported on the shelf 12 and each disposed beneath a respective opening in the sorter plate for receiving a particular denomination of coin.

The bagging spouts 20 are wedge-shaped and are provided with indentations 21 on each front edge for grasping by the hand of an operator. The spouts 20 include a spout member 22 having an internal chute 23 that is inclined from the vertical and extends between a top inlet opening 24 to a forward outlet opening 25. A spreader plate 26 extends downwardly and laterally from the underside of the forward end of the chute 23 adjacent the outlet 25. The top of the spout member 22 is open except for a bridge portion 27 which spans side portions 28 and 29 of the chute 23.

A cover member 30 has tabs 31 extending laterally from its sides. The tabs 31 are received in circular openings 32 in the side portions 28 and 29 of the chute 23. The tabs can rotate within the openings 32 so that the cover 30 is hinged to the spout member 22. The cover 30 has portions that extend forward and rearward of the tabs 31 to effectively close off the open top of the spout member 22. A forward portion of the cover 30 contains integral ears 35 that extend downwardly and can oppose the side portions 28 and 29 of the chute 23. The inner surfaces of the ears 35 may be provided with serrations 36 for purposes of gripping a coin bag. The cover 30 also includes a lip 38 that extends forward of the ears 35 and away from the bridge portion 27 to allow manual gripping of the cover 30.

Figure 5:
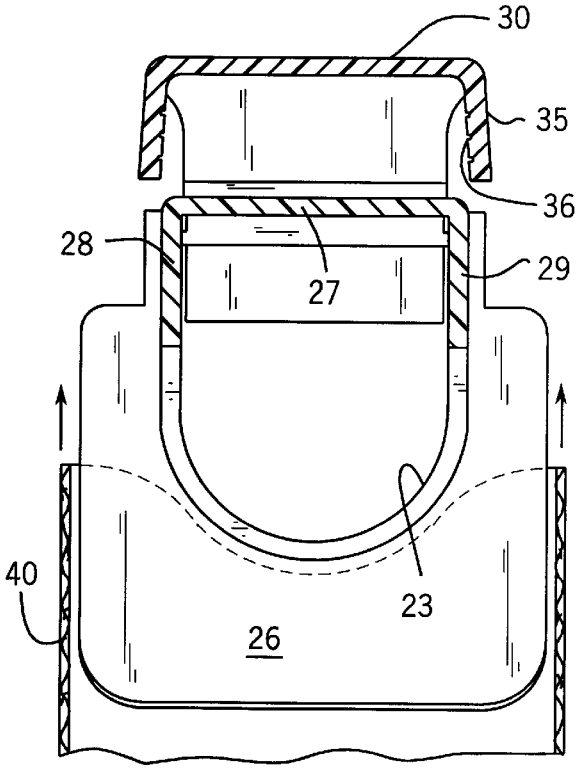
FIGS. 5 and 6 are views similar to FIG. 4 but showing the attachment of a bag onto the bagging spout.
Figure 6:
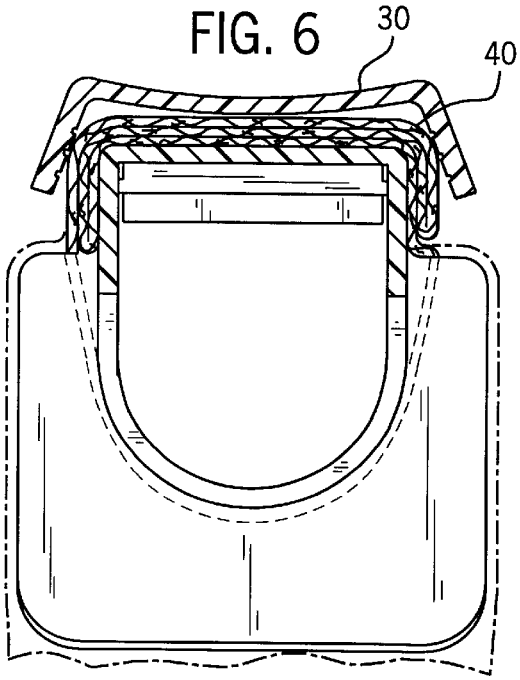

In operation, one side of a coin bag 40 is disposed beneath the chute 23 behind the spreader plate 26. The remaining portions of the bag 40 are folded over the top of the chute 23 above the bridge portion 27. The cover 30 is then moved downwardly to have the ears 35 pinch the folded portions of the bag 40 between the ears 35 and the side portions 28 and 29 of the chute 23. The position of the bag on the spout during attachment is shown in FIG. 5, and FIG. 6 shows the bag in place upon the spout.

The bridge portion 27 extends outwardly from the spout member 22 and is spaced forward of the spreader plate 26. The spreader plate 26 and the overhanging bridge portion 27 combine to keep the mouth of the bag 40 open in all directions once the bag 40 is installed on the spout 20.

The open top of the spout member 21 facilitates the moldability of the spout member 21. The top could be closed as well. Also, a cover member could be formed as a stiff wire shaped to match the perimeter of the cover member 30. Further enhancements to the bagging spout may include teeth or other projections on the underside of the cover member 30 cooperating with the bridge portion 27 to help grip the coin bag and outward projections on the side portions 28 and 29 together with inward flanges on the ends of the ears 35 that snap over the outward projections to provide a positive seating of the cover member 30 on the spout member 22.

The spout with its inclined chute is particularly useful for table top coin handling machines since it holds the bags at a higher level relative to the machine than the vertical spouts that have been used.

We claim:

1. A bagging spout for a coin handling machine, comprising:

a spout member having an upper inlet and a lower outlet and generally parallel spaced side portions extending between the inlet and outlet;

a spreader plate extending transversely and downwardly from the spout member adjacent the outlet; and a clamp member hinged to a top of the spout member adjacent the inlet and having extending ears that are spaced apart more than the side portions, the ears adapted to engage with the side portions of the spout member to trap a coin bag between the ears and the spout member.

2. A bagging spout in accordance with claim 1, wherein the clamp member has a lip portion that extends away from spout member at the outlet for manual gripping.

3. A bagging spout in accordance with claim 1, wherein the spout member has an inclined chute between the inlet and the outlet and the spreader plate extends downwardly and laterally from the side portions of the spout member.

4. A spout in accordance with claim 3 wherein the outlet is defined by a bridge portion at the end of the chute, and the bridge portion is spaced forward of the spreader plate.

5. A spout in accordance with claim 1 wherein the surfaces of the ears that engage the coin bag are provided with serrations.

6. A bagging spout for a coin handling machine, comprising:

a spout member having an inlet and an outlet;

a spreader plate extending transversely from one side of the spout member; and a clamp member hinged to an opposite side of the spout member and having spaced extending ears that engage with the spout member to trap a coin bag between the ears and the spent member, the spout member having an open side that is closed by the hinged clamp member.

7. In a coin handling machine having a plurality of coin discharge stations arrayed along a circle beneath the machine, and a plurality of coin collectors each disposed beneath a respective one of the discharge stations, the improvement wherein at least one of the coin collectors comprises a bagging spout having:

a spout member having an inlet adjacent the discharge station and an inclined chute leading from the inlet to an outlet, the chute having generally parallel spaced side portions extending between the inlet and the outlet;

a spreader plate extending downwardly from the underside of the spout member; and a cover member hinged to the top side of the spout member adjacent the inlet and having downwardly extending ears that are spaced apart a distance greater than the side portions of the chute to trap a coin bag between the ears and the sides of the chute.

* * * * *